United States Patent [19]

Ericsson

[11] Patent Number: 4,578,912

[45] Date of Patent: Apr. 1, 1986

[54] FOUNDATION FOR CELLARLESS HOUSES

[75] Inventor: Roger Ericsson, Holmsund, Sweden

[73] Assignee: Profoment Utvecklings AB, Umeå, Sweden

[21] Appl. No.: 624,248

[22] Filed: Jun. 25, 1984

[30] Foreign Application Priority Data

Jun. 30, 1983 [SE] Sweden ..... 8303737

[51] Int. Cl.[4] ..... F24F 7/00

[52] U.S. Cl. ..... 52/169.5; 52/302; 52/303; 98/31

[58] Field of Search ..... 52/169.5, 302, 303, 52/304, 305, 474, 483, 479, 633; 98/31, 32, 33 R, 33 A, 40 C, 42 R

[56] References Cited

U.S. PATENT DOCUMENTS

| | | | |
|---|---|---|---|
| 2,804,657 | 9/1957 | Munters | 52/303 |
| 2,811,850 | 11/1957 | Clary . | |
| 3,094,745 | 6/1963 | Stout | 52/303 |
| 3,291,026 | 12/1966 | Simpson | 98/31 |
| 3,771,273 | 11/1973 | Brodie | 52/302 X |
| 3,905,548 | 9/1975 | Brodie . | |
| 4,295,415 | 10/1981 | Schneder, Jr. | 52/303 X |
| 4,296,798 | 10/1981 | Schramm | 52/303 X |

FOREIGN PATENT DOCUMENTS

| | | | |
|---|---|---|---|
| 2519658 | 11/1975 | Fed. Rep. of Germany | 52/302 |
| 2511962 | 10/1976 | Fed. Rep. of Germany | 52/169.5 |
| 2293672 | 7/1976 | France . | |
| 1547666 | 10/1968 | France . | |
| 2473161 | 7/1981 | France | 52/303 |
| 391976 | 3/1977 | Sweden . | |
| 400362 | 3/1978 | Sweden . | |
| 981921 | 1/1965 | United Kingdom | 52/303 |
| 1069632 | 5/1967 | United Kingdom . | |
| 800505 | 1/1981 | U.S.S.R. | 52/302 |
| 975946 | 11/1982 | U.S.S.R. | 52/302 |

*Primary Examiner*—Donald G. Kelly
*Assistant Examiner*—Richard E. Chilcot, Jr.
*Attorney, Agent, or Firm*—Spencer & Frank

[57] ABSTRACT

A foundation for cellarless houses comprises a foundation wall (6) whose underside is disposed on a level below the ground surface (4) surrounding the house (1) and serves to support the house and, together with a bearing floor structure (5), also to define a bottom space (12) in the area above the ground on which the house is erected. The floor structure (5) has a lower portion which is air permeable in order, via the floor structure, to permit supplying air of substantially room temperature to said bottom space (12) from which the air is thereafter evacuated. According to the invention, said lower portion exclusively consists of a thin air-permeable web (11), and a heat insulating layer (21) for the foundation is placed directly on the ground (20) underneath the floor structure.

14 Claims, 3 Drawing Figures

FOUNDATION FOR CELLARLESS HOUSES

BACKGROUND OF THE INVENTION

This invention relates to a foundation for cellarless houses of the type comprising a suitably frame-like or otherwise endless foundation wall whose underside is disposed on a level below the surface of the ground surrounding the house and which serves to support the house while defining, together with a bearing floor structure, a bottom space in the area above the ground on which the house is erected, said floor structure having a lower portion which is air permeable in order, via said floor structure, to permit supplying air of substantially room temperature, suitably in the form of exhaust air from the interior of the house, to said bottom space from which the air is evacuated, suitably through an evacuation conduit or duct passing through the floor structure.

Cellarless houses have long been erected on foundations of basically two different types, via. either conventional cottage foundations with foundation walls of a considerable height or whole slabs placed directly on the ground.

Both conventional cottage foundation and foundation slabs are relatively expensive solutions to the foundation problem and, even in the most elaborate designs, do not provide for good heat comfort indoors. Also where the floors are rigorously insulated, they will never feel properly heated. For this and many other reasons, a novel type of foundation has lately been developed which may be referred to as forced flow foundation and which is based on the idea of conducting the relatively warm exhaust air from the interior of the house down into the space below the floor and from there through an air-permeable layer (which may consist of either the lower portion of the floor structure or a separate layer, e.g. of mineral wool, underneath the bearing floor structure) to the crawl way or bottom space from which the air is evacuated through a duct which extends up through the floor structure and the house and communicates with the ambient atmosphere. Such a forced flow foundation is disclosed in Swedish patent specification No. 7511197-1. The advantages of such a system are that it provides for good heat comfort in the form of warm floors in the house while minimising the amount of heat insulating material in the floor structure and, hence, heat insulation costs, and also that the depth of the foundation can be significantly reduced in that the space underneath the house is kept warm and will thus heat the ground below the house whereby to avoid frost heave.

However, since the forced flow system uses an insulated floor structure over a space defined by the foundation wall, it has hitherto been regarded merely as a further development of the conventional cottage type foundation. Thus, the underside of the floor structure has been disposed on a level above the ground surrounding the house with a high crawl way below the house and with the same, relatively complicated wall connections as in the conventional cottage type foundation. As opposed to the relatively poor and inexpensive insulation of the upper portion of the foundation wall used in the cottage type system, the foundation wall of the forced flow system must however be insulated in its entirety both accurately (in a moisture-proof way) and extensively, since heat losses through the foundation wall are not acceptable. The savings of the forced flow system by a reduced foundation depth and less insulation of the floor structure have therefore been offset by the increased insulation of the foundation wall and the more expensive mounting of the so-called pressure drop or distributing layer which is required for allowing air to pass between the interior of the floor structure and the underlying crawl way. In view hereof, the forced flow system, despite its advantages in respect of insulation and heat comfort, has not had any notable commercial success.

SUMMARY OF THE INVENTION

It has now surprisingly been found that the above mentioned heat insulating layer in the lower portion of the floor structure can be dispensed with, whereby a number of unexpected advantages can be gained in regard of both building technology and economy. Thus, the invention is characterised more specifically in that said lower portion exclusively consists of a thin air-permeable web, for instance a perforated foil or a loosely woven cloth, and that a heat insulating layer is placed directly on the ground below the floor structure.

BRIEF DESCRIPTION OF THE DRAWINGS

In the appended drawings.

DESCRIPTION OF THE PREFERRED EMBODIMENTS

Figure 1:
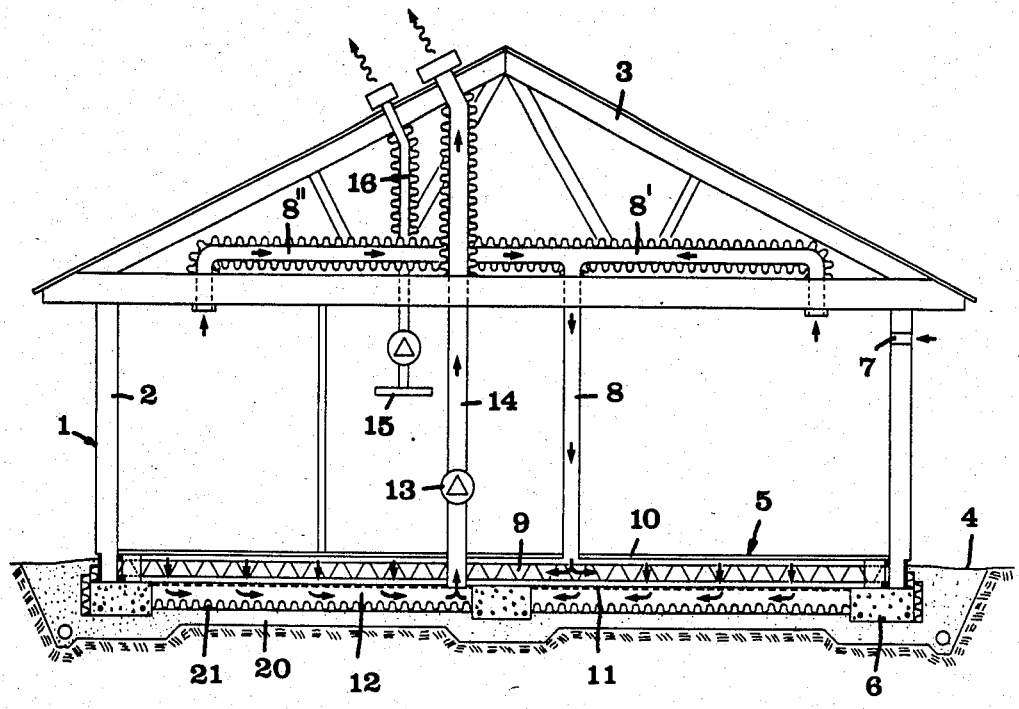
FIG. 1 is a highly schematic cross-section of a house erected on the foundation according to the invention, FIG. 2, on a larger scale, is a cross-section of a portion of said foundation.

In FIG. 1, a house generally designated 1 includes in a conventional way at least four external walls 2 and a roof 3. The prepared ground which surrounds the house is designated 4. A floor structure 5 is placed on a foundation wall generally designated 6.

Fresh supply air is taken into the interior of the house 1 through a suitable number of valves 7 in the walls 2. Once within the various rooms of the house, the air will be heated and withdrawn from the rooms through a first duct system comprising a number of branch ducts 8', 8'' merging into a common main duct 8 which opens in the floor structure 5 and more precisely in a free space 9 located immediately below the floor panel 10 which is part of the floor structure. The floor structure also comprises a lower portion in the form of a pressure drop layer generally designated 11 which is air permeable so as to allow the warm exhaust air flowing into the space 9 to pass on to a subjacent space 12, hereinafter referred to as bottom space, while distributing the air substantially evenly along the entire surface of the foundation. From the bottom space 12, the air is sucked out by a fan 13 mounted in a second duct 14 in the form of an evacuation duct which extends through the floor structure 5 and communicates with the ambient air. The exhaust air which is thus used is suitably first drawn from such rooms, e.g. bedrooms and living rooms, as do not affect the purity of the air to any notable extent, and is passed on as transferred air to more contaminated rooms, such as kitchen, WC, bathroom and the like, from which it will finally be conducted down into the foundation as described above. Highly polluted air, for instance from a kitchen fan 15, is suitably exhausted directly into the ambient air through a separate duct 16 without being permitted to pass through the foundation.

Figure 2:
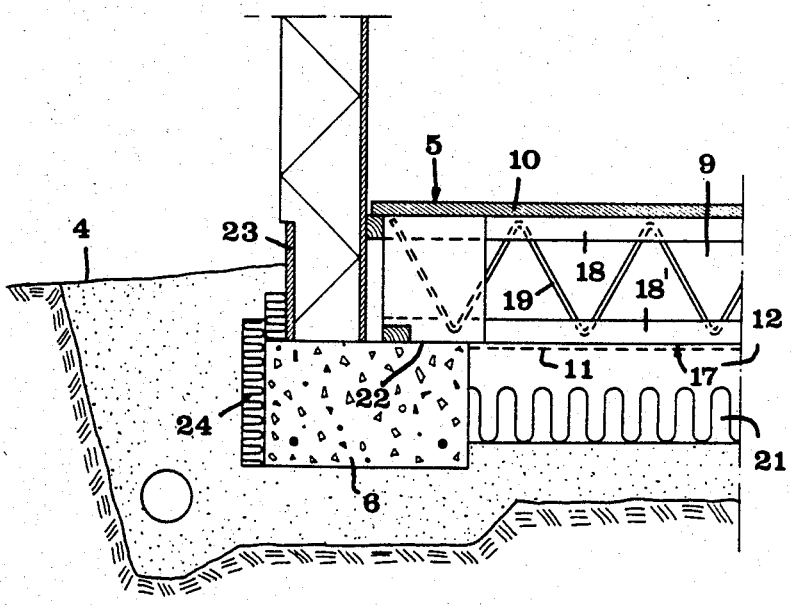
Figure 3:
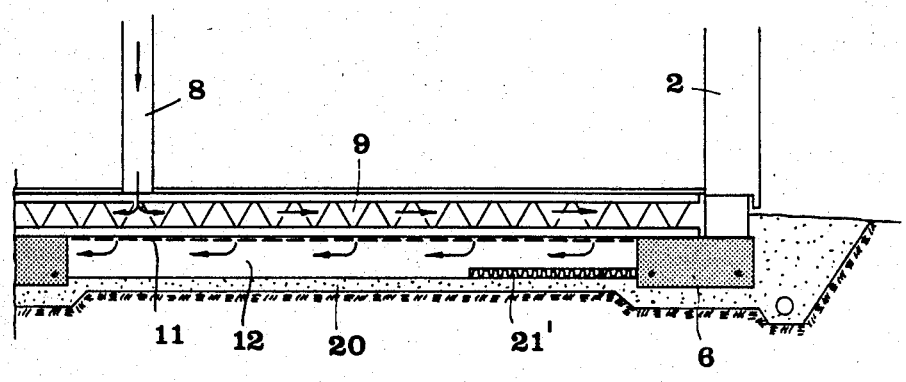
FIG. 3 is a cross-section of a portion of an alternative embodiment of the construction according to the invention.

Reference is now made to FIGS. 2 and 3 which illustrate in more detail the features of the foundation according to the invention. In addition to the floor panels forming the floor 10 of the house, the floor structure 5 includes a number of beams 17 which, in the described embodiment, each comprise upper and lower flanges 18, 18' which are interconnected by a web construction consisting of zigzag-shaped wires or rods 19.

Characteristic of the foundation according to the present invention is that the lower portion of the floor structure 5 exclusively consists of a flexible air-permeable web or unit 11 which, in actual practice, may consist of a perforated plastic foil, a loosely woven cloth or the like. Suitably, this air-permeable web, as illustrated in the drawing, is applied in its entirety to the underside of the lower flanges 18' of the beams 17 forming the floor structure, although it is conceivable to fix webs on the lateral surfaces of these flanges, i.e. on a level slightly above the undersides of the lower flanges.

The foundation of the invention is further characterised in that a heat insulating layer is placed directly on the ground area 20 below said floor structure. In the embodiment according to FIGS. 1 and 2, an insulation 21 covering the entire ground area has been placed on the upwardly exposed ground surface whereas the embodiment of FIG. 3 merely uses a relatively narrow, suitably strip-shaped unit 21' applied to the ground in the immediate vicinity of the foundation wall 6. In both cases, the heat insulating layers 21, 21' may advantageously consist of mineral wool of a suitable thickness.

As compared with previously known foundations of the forced flow type, the construction according to the invention confers a number of advantages. In that the underlying ground is insulated, there will be a relatively low energy transfer by the warm air down into the ground. The contemplated insulation layers 21, 21' may be designed in such a manner that they will allow just as much energy to pass as is required to heat the ground to a temperature sufficient to keep the frost off the house. This will raise the temperature of the air circulating through the foundation, which in turn entails a number of positive effects. The most essential effect is that the moisturetransporting capacity of the air will be markedly increased, thus giving a more damp-proof construction in which there is no risk of condensation because the air in the bottom space 12 is cooled. Further, the air leaving the foundation will have a relatively high energy content which can be used for heat exchange or a heat pump. By eliminating the heat insulating layer previously used in the lower portion of the floor structure and forming part of the pressure drop layer, the reduction of the air temperature will not start until the air has passed the lower flanges of the beams. These flanges being suitably made of wood will thus be located in a zone of relatively warm, not yet cooled air and so, they will not be subjected to the relative increase of air humidity which would otherwise have occurred. Finally, it should be pointed out that the cloth or web 11 alone is capable of distributing the incoming warm air over the entire space 9 and down into the space 12 while maintaining a high temperature at the upper face of the cloth and efficiently counteracting transmission of heat from the interior of the house and providing for a warm floor 10.

As shown in the drawings, the underside 22 of the described floor structure 5 is located, according to the invention, on a level which is below that of the ground surface 4 surrounding the house 1. More specifically, the floor structure 5 is placed on the inner portion of a concrete beam which forms the foundation wall 6 and which, as desired, may be prefabricated or made in situ and which, like the concrete slab foundation mentioned in the introductory clause of this specification, can be disposed extremely high relative to the ground level 4, i.e. need not be disposed at frostproof depths. In other words, the foundation wall beam 6 may be given minimum dimensions and, thus, requires little material. It should here be observed that the beams which together form the frame-like or surrounding foundation wall 6 are completely sealing in the sense that they have no valves at all, whereby warm air only will pass through the bottom space 12 and out through the duct 14.

As further appears from FIG. 2, the connection of the walls 2 to the foundation wall will be extraordinarily simple in that the walls can be placed directly on the foundation wall 6 and more precisely on the accessible outer portion thereof outside the ends of the floor structure. At the lower portion of the outer side of the wall, there may be mounted a simple cement-based plate 23 protecting against the surrounding soil or sand. Further, there may be applied at the outer side of the foundation wall 6 a simple and inexpensive heat insulating layer 24, for instance a 50 mm sheet of mineral wool.

Since the bottom space 12 is always kept heated, the drain pipes of the house will not risk getting frozen and so, they may be disposed in this space without any possibility of access.

In that the space 12, because of its extremely low height, has a very small volume, the flow rate of the air passing therethrough will be high. This means an advantageously low moisture load in this space.

It should be pointed out that the expression "foundation wall" as used in this specification and the accompanying claims should be interpreted in its very widest sense. Thus, the foundation wall may consist not only of truly bricked building elements but just as well, as exemplified above, of concrete or other cast beams or elements or of any other suitable material which is capable of supporting the house and simultaneously delimiting the bottom space 12 in an airtight manner. In this context, it should also be noted that the geometrical design of the foundation wall may be varied in several ways. For example, it is possible, on the outer portion of the unit 6, to build a suitably low brick layer on which the walls 2 are placed.

It goes without saying that the invention is not restricted only to the embodiments described above and illustrated in the drawings. Thus, it is possible to place the floor structure 5 on a level which is even higher than the ground surrounding the house, although it is preferred to dispose the floor structure as deep as possible. Further, it is conceivable to cause air other than precisely exhaust air to circulate through the foundation as described above. For example, it is possible to conduct air from one or more bedrooms down into the space 9 and through the pressure drop layer 11 on to the bottom space 12 and from there to the kitchen of the house and only thereafter evacuate it as exhaust air. Although it is preferred to have the evacuation duct 14 pass directly up through the floor structure 5, as exemplified in the drawings, it is also possible in actual practice to evacuate the air from the bottom space 12 in any other suitable manner. Especially where several houses in a group are concerned, for instance a number of coherent terraced houses or the like, it may be convenient to make the duct discharge through the foundation, more specifically in the form of an evacuation duct which is common to all the houses and which is passed through two or more foundations, whereas not up through the floor structure, to a suitably positioned outlet.

I claim:

1. A cellarless house having at least one room, comprising:

an endless foundation wall which encloses a region of ground, said foundation wall having an underside that is disposed on a level below the surface of the ground surrounding said wall;

a floor structure which is at least partly supported by said foundation wall, said floor structure including spaced apart beams having upper and lower flanges and having means interconnecting said upper and lower flanges for allowing air to pass between spaces located on either side of each beam, a floor panel supported by said upper flanges, and a thin, air-permeable web mounted on said lower flanges, said web being spaced above the region of ground enclosed by said foundation wall;

means for supplying air, at substantially the temperature of said at least one room, between said floor panel and web;

a heat insulating layer placed on the ground beneath said floor structure, said heat insulating layer being spaced apart from said web; and means for evacuating air from the region between said heat insulating layer and said web.

2. The house of claim 1, wherein said heat insulating layer substantially covers the entire surface of the region of ground enclosed by said foundation wall.

3. The house of claim 1, wherein said heat insulating layer comprises at least one strip-shaped unit of insulation positioned adjacent said foundation wall.

4. The house of claim 1, wherein both said web and the surface of the ground enclosed by said foundation wall are disposed on a level below the surface of the ground surrounding said foundation wall.

5. The house of claim 4, further comprising an exterior wall having an inner side, wherein said floor structure has a substantially vertical end face portion, and wherein said exterior wall and floor structure are placed directly on said foundation wall, with said end face portion being disposed immediately inward of said inner side.

6. The house of claim 5, wherein said exterior wall has a lower portion that extends to a level below that of the surface of the ground surrounding said foundation wall.

7. The house of claim 6, wherein said exterior wall additionally has an outer side, and further comprising moisture-proof plates at the lower portion of the outer side.

8. The house of claim 4, further comprising an exterior wall having a lower portion that extends to a level below that of the surface of the ground surrounding said foundation wall.

9. The house of claim 8, wherein said exterior wall has an outer side with a lower portion, and further comprising moisture-proof plates at the lower portion of the outer side.

10. The house of claim 1, wherein said means for supplying air comprises means for supplying exhaust air from said at least one room.

11. The house of claim 1, wherein said means for evacuating comprises an evacuation conduit having an opening which communicates with the region between said heat insulating layer and said web.

12. The house of claim 1, wherein said web is a perforated foil.

13. The house of claim 1, wherein said web is a loosely woven cloth.

14. The house of claim 1, wherein said flanges are wood.

* * * * *